US006464490B1

(12) United States Patent
Chato

(10) Patent No.: US 6,464,490 B1
(45) Date of Patent: Oct. 15, 2002

(54) CIRCULAR PULSATING COMBUSTORS

(75) Inventor: John D. Chato, Vancouver (CA)

(73) Assignee: Clean Energy Combustion Systems, Inc. (CA)

( * ) Notice: Subject to any disclaimer, the term of this patent is extended or adjusted under 35 U.S.C. 154(b) by 0 days.

(21) Appl. No.: 09/763,872

(22) PCT Filed: Aug. 27, 1999

(86) PCT No.: PCT/CA99/00788

§ 371 (c)(1),
(2), (4) Date: Apr. 27, 2001

(87) PCT Pub. No.: WO00/12934

PCT Pub. Date: Mar. 9, 2000

Related U.S. Application Data

(60) Provisional application No. 60/098,540, filed on Aug. 31, 1998.

(51) Int. Cl.[7] ..... F23C 11/04; F23C 3/02; F24H 1/26

(52) U.S. Cl. ..... 431/1; 431/1; 431/354; 431/160; 60/39.78; 60/39.8; 60/39.76; 60/39.77; 122/24

(58) Field of Search ..... 431/1, 354, 160; 60/39.78, 39.8, 39.76, 39.77; 122/24

(56) References Cited

U.S. PATENT DOCUMENTS

| | | | | |
|---|---|---|---|---|
| 2,635,420 | A | 4/1953 | Jonker | 60/35.6 |
| 2,748,753 | A | 6/1956 | Sarrazin et al. | 122/24 |
| 3,119,436 | A | 1/1964 | Rydberg | 158/4 |
| 3,169,570 | A | 2/1965 | Haag et al. | 158/4 |
| 3,738,290 | A | 6/1973 | Belter | 110/28 R |
| 4,314,444 | A | 2/1982 | Putnam et al. | 60/39.77 |
| 4,318,392 | A | 3/1982 | Schreiber et al. | 126/110 R |
| 4,479,484 | A | 10/1984 | Davis | 126/362 |
| 4,569,310 | A | 2/1986 | Davis | 122/24 |
| 4,639,208 | A | 1/1987 | Inui et al. | 431/1 |
| 4,708,634 | A | 11/1987 | Vergne | 431/1 |
| 4,750,452 | A | 6/1988 | Trihey | 122/24 |
| 4,759,312 | A | 7/1988 | Pletzer | 122/24 |
| 4,846,149 | A | 7/1989 | Chato | 126/360 R |
| 5,044,930 | A | 9/1991 | Hongo et al. | 431/1 |
| 5,242,294 | A | 9/1993 | Chato | 431/1 |

FOREIGN PATENT DOCUMENTS

| | | | |
|---|---|---|---|
| FR | 1050881 | 1/1954 | 6/4 |
| JP | 58200910 | 11/1983 | 23/11 |
| SU | 877227 | 11/1981 | 23/11 |
| WO | 9100210 | 6/1991 | |

*Primary Examiner*—Henry Bennett
*Assistant Examiner*—Kathryn Ferko
(74) *Attorney, Agent, or Firm*—Liniak, Berenato, Longacre & White, LLC

(57) ABSTRACT

A pulsating combustor has a plurality of annular plate elements (12), which are stacked in spaced vertical alignment so as to define a central space (14). There is a plurality of slot-like passages (18), one such passage between each adjacent pair of elements. There is at least one combustion chamber (21) in communication with at least one slot-like passage. Fuel and combustion air are fed into the combustion chambers. There is a spark plug for igniting a fuel-air mixture in the combustion chamber. Preferably there is a first housing (24) defining the combustion chamber and another housing defining a collection chamber for combustion gases emerging from the passages.

8 Claims, 6 Drawing Sheets

CIRCULAR PULSATING COMBUSTORS

This application claims the benefit of U.S. provisional application No. 60/098,540, filed Aug. 31, 1998.

This invention relates generally to an improved design for a pulsating combustor. More particularly, this invention is directed to a pulsating combustor design based on an annular or "doughnut" configuration, generally consisting of a plurality of identical annular units which can be stacked to any desired height, thus providing a widely adaptable combustor capable of enlargement or reduction to fit into any available space.

BACKGROUND OF THE INVENTION

A significant prior patent is my own U.S. Pat. No. 4,846,149, issued Nov. 7, 1989, and entitled "Fluid Heater Using Pulsating Combustor."

Pulsating combustion has been studied since the early part of the century, and many different types of linear pulse burners, incorporating both flap valve and aerodynamic types of fuel inlets have been constructed.

Studies I have carried out relating to the pulsating blade combustor that is set forth in my U.S. Pat. No. 4,846,149 identified above, have shown that it is advantageous to achieve a resonance match between the fuel intake pipe, and the combustor itself. Generally, the concept of resonance refers to a condition in which a vibrating system responds with maximum amplitude to an alternating driving force. This condition exits when the frequency of the driving force coincides with the natural undamped oscillatory frequency of the system.

Thus, a pulse burner, operating in the resonating mode, provides the greatest potential for:

(a) a maximum amplitude pressure wave;

(b) maximum heat flux potential;

(c) maximum potential for complete combustion.

Resonance matching has shown itself to be particularly advantageous in the utilization of higher frequencies, about which a brief discussion is appropriate.

As mentioned above, an advantage of higher frequencies in commercial pulse combustors lies in the ability to control the burner noise due to the shorter sound wave-length. This means that a smaller resonant cavity is necessary in the exhaust duct to control the inherent operating sound of the combustor. An additional advantage arises in the suppression of NOx which is also due to the shorter pulse duration that interferes with the kinetics of NOx formation. Until recently, however, tubular high frequency devices (>350 Hz) were a laboratory curiosity only, and were not commercially viable due to their inherent low capacity. High efficiency pulsating combustors are presently on the market but are characterized by a low operating frequency of around 50 Hz. This is necessary in a tubular unit so that the capacity and surface area for heat transfer is large enough to provide a practical size of domestic burner.

The pulse blade combustor which is set forth in my above-identified U.S. Pat. No. 4,846,149 operates in the same linear mode as a tube pulse burner, but burns on a flat rather than a circular flame front. The novelty of that approach is apparent in view of the fact that it was hitherto believed by researchers in the field that the viscous drag over a vastly increased heat transfer area would inhibit the combustion. This was found not to be the case, and I was able to successfully construct an operating pulse blade combustor incorporating aerodynamic valving of natural gas, the unit having a width of approximately 30 cm and a length of approximately 36 cm. The operating frequency was 441 Hz and the gas consumption was nominally 100,000 BTU/Hr. This unit is adapted for incorporation into a water heater which, with some residual heat reclaimed from the exhaust gases, acts with a percentage efficiency in the high 90's.

While the design in the U.S. Pat. No. 4,846,149 is capable of a high rate of heat transfer through the walls to a cooling medium such as water, the shape of the item in the issued U.S. patent is not conducive to compactness of size for some applications.

Other attempts to utilize a pulsating combustor to heat water have encountered problems in muffling the sound of the unit. More particularly, the prior art combustors have generally taken the shape of a "bottle" with an elongated neck portion (the tailpipe), and with combustion taking part in the main portion of the "bottle". Unfortunately, it is found with this prior art design that the tailpipe has to be overly long in order to provide a sufficiently large heat transfer surface. With a long tailpipe, however, the frequency of the pulsating combustion is generally in the low range, typically around 50 cps. A low-pitched noise of this kind is very difficult to damp out, and as a result water heaters or boilers which utilize this pulsating combustor design tend to be very noisy.

My earlier U.S. Pat. No. 5,403,180 discloses and claims an improvement whereby the fuel intake and the combination of the combustion chamber and the tail pipe portion each have a characteristic resonant frequency depending on its dimensional characteristics. The resonant frequency of the fuel intake in the resonant frequency of the combination of the combustion chamber and the tail pipe portion are related to each other as the ratio between two whole numbers less than 6.

U.S. Pat. No. 4,968,244 to Movassaghi shows a pulsating combustor of the type including a pair of annular plate elements stacked so as to define a central space and a slot-like passage between the adjacent pair of elements. There is a combustion chamber in communication with the passage. Means is provided for feeding fuel and combustion air to the combustion chamber. There is also means for igniting a fuel-air mixture in the combustion chamber.

WO 97/20171 discloses pulsating combustors which contain two annular plate elements and a slot-like passage therebetween.

Despite the advantages attained by the combustors disclosed in the above prior U.S. patents, there remains a need for a combustor which combines compactness of construction with an adaptability to spaces of different dimensions, and which can be reliably constructed at reasonable cost.

SUMMARY OF THE INVENTION

It is an object of one aspect of this invention to provide a pulsating combustor having an annular body consisting of a plurality of individual combustor units in stacked relation, each extending about a central space. The combustor head is situated in the central space, while a housing externally of the annular body collects the combustion gases. The head may provide a single common combustion chamber for a plurality of radially extending tail-pipe spaces, or alternatively may provide, in cooperation with the structure of the annular body, a plurality of separate combustion chambers, one for each tail-pipe space.

In a variant, the flow of gases can be reversed, with a combustion head defined by a housing around the outside of the annular body and the housing means in central aperture of the annular body for collecting combustion gases and removing these from the burner.

More particularly, this invention provides a pulsating combustor comprising:

a plurality of like annular plate elements stacked in spaced vertical alignment so as to define a central round space containing the common axis of the elements and a plurality of slot-like passages, one such passage between each adjacent pair of elements;

a first housing within the round opening and a second housing externally of the elements;

one said housing defining at least one combustion chamber in communication with at least one of said slot-like passages;

first means for feeding fuel and combustion air to said at least one combustion chamber;

second means for igniting a fuel-air mixture in said at least one combustion chamber;

the other housing defining a collection chamber for combustion gases emerging from said at least one slot-like passage.

GENERAL DESCRIPTION OF THE DRAWINGS

Several embodiments of this invention are illustrated in the accompanying drawings, in which like numerals denote like parts throughout the several views, and in which.

Figure 4:
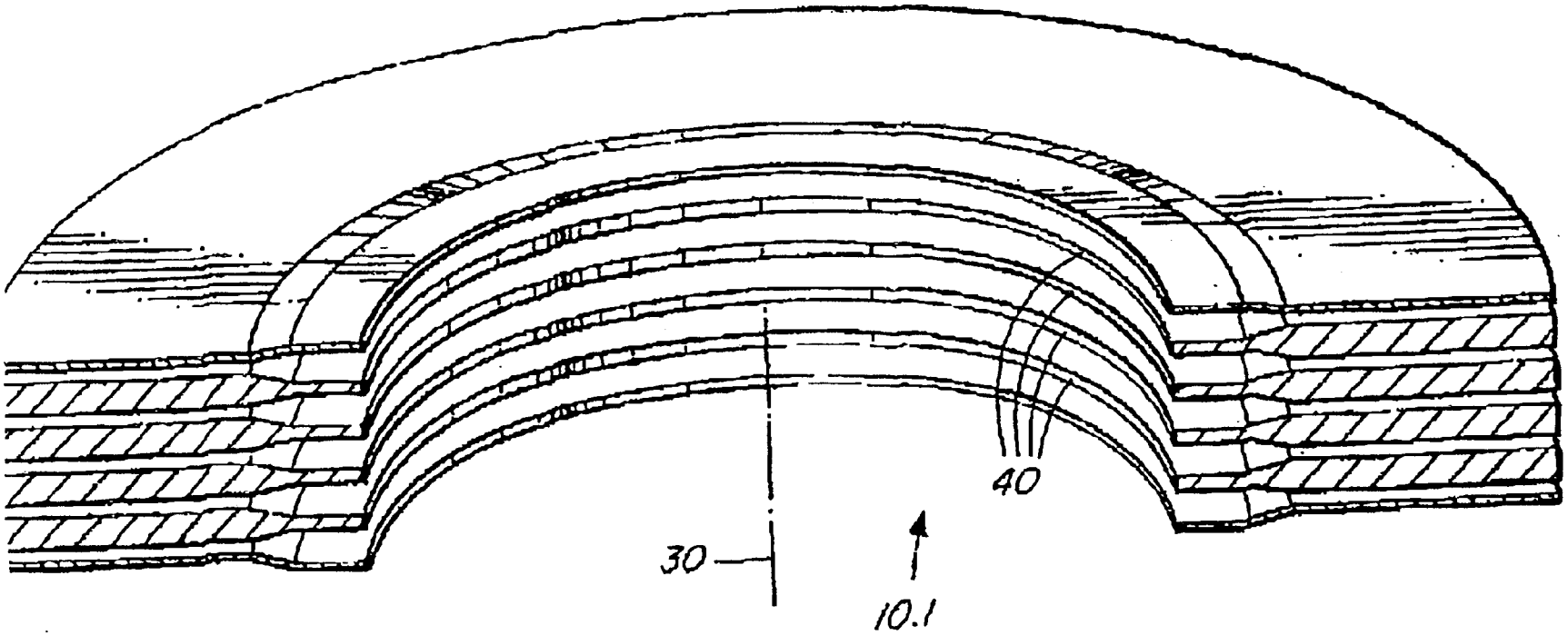
FIG. 4 is a perspective view of the FIG. 3 embodiment.
Figure 5:
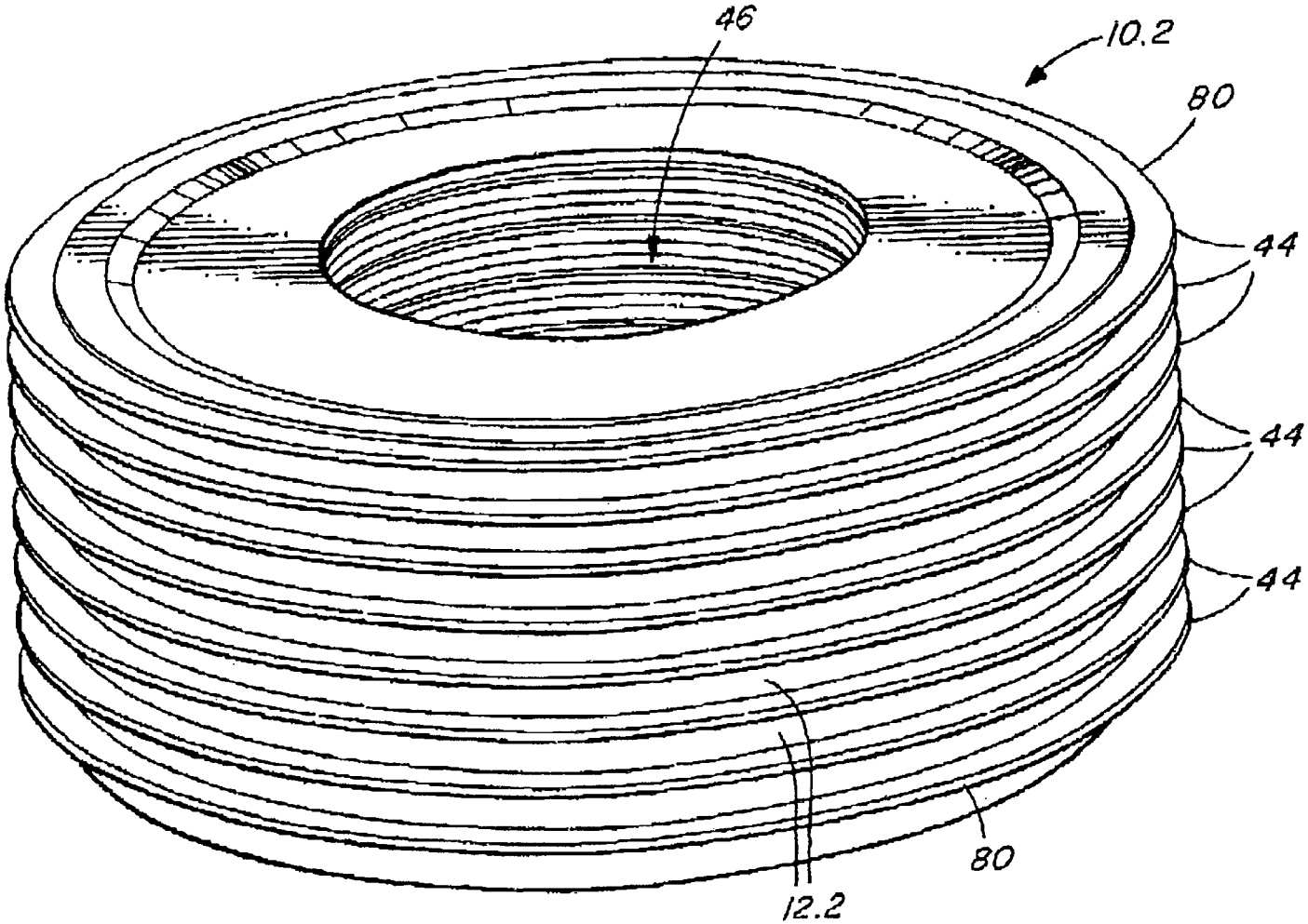
Figure 6:
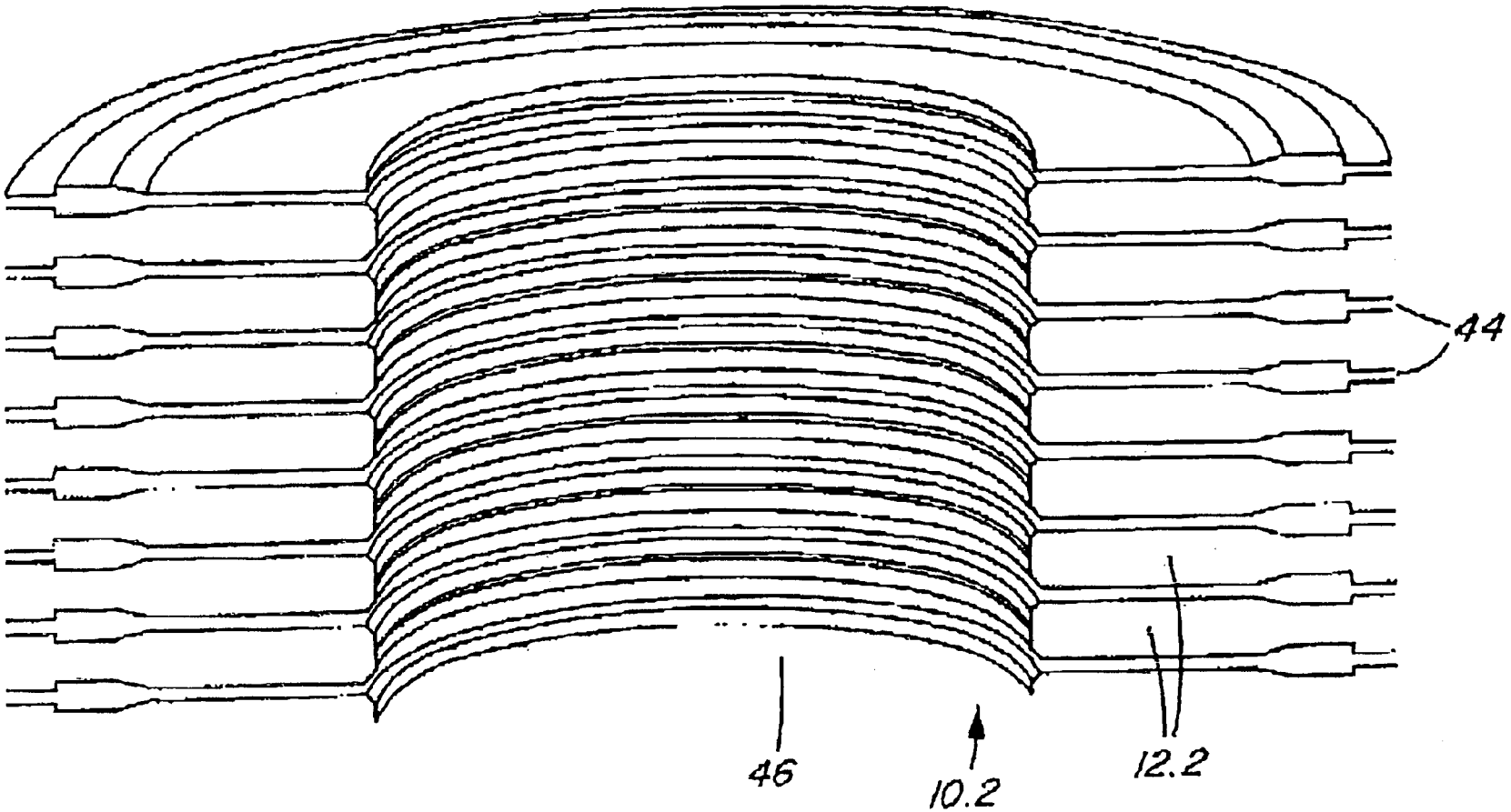

FIG. 5 is a perspective view of a version of the invention wherein the movement of gaseous material is radially inward along slots defined between vertically spaced apart annular elements, with a common combustion chamber (not illustrated) externally of the annular stack, and an exhaust-gas collection housing (not illustrated) located in the central space of the stack; and FIG. 6 is a perspective view similar to FIG. 4, but showing the radial inflow embodiment, wherein the individual combustion chambers are provided adjacent the outside of the annulus; and

DETAILED DESCRIPTION OF THE PREFERRED EMBODIMENTS

Figure 1:
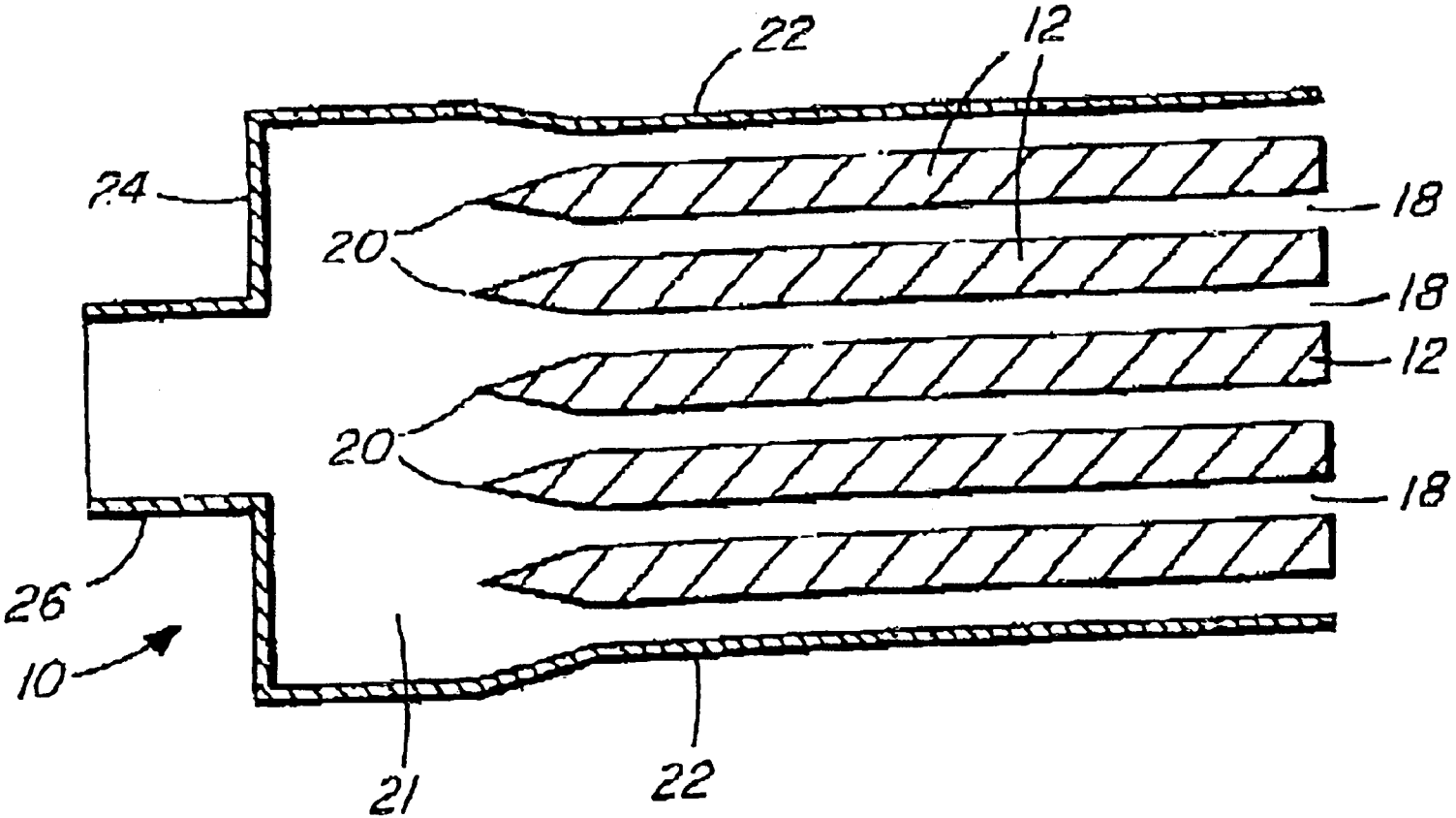
FIG. 1 is a sectional view through the annulus taken in a plane containing the axis of symmetry of the annuls and showing an embodiment in which a single or common combustion chamber is defined, the common combustion chamber communicating with all exhaust slots.
Figure 2:
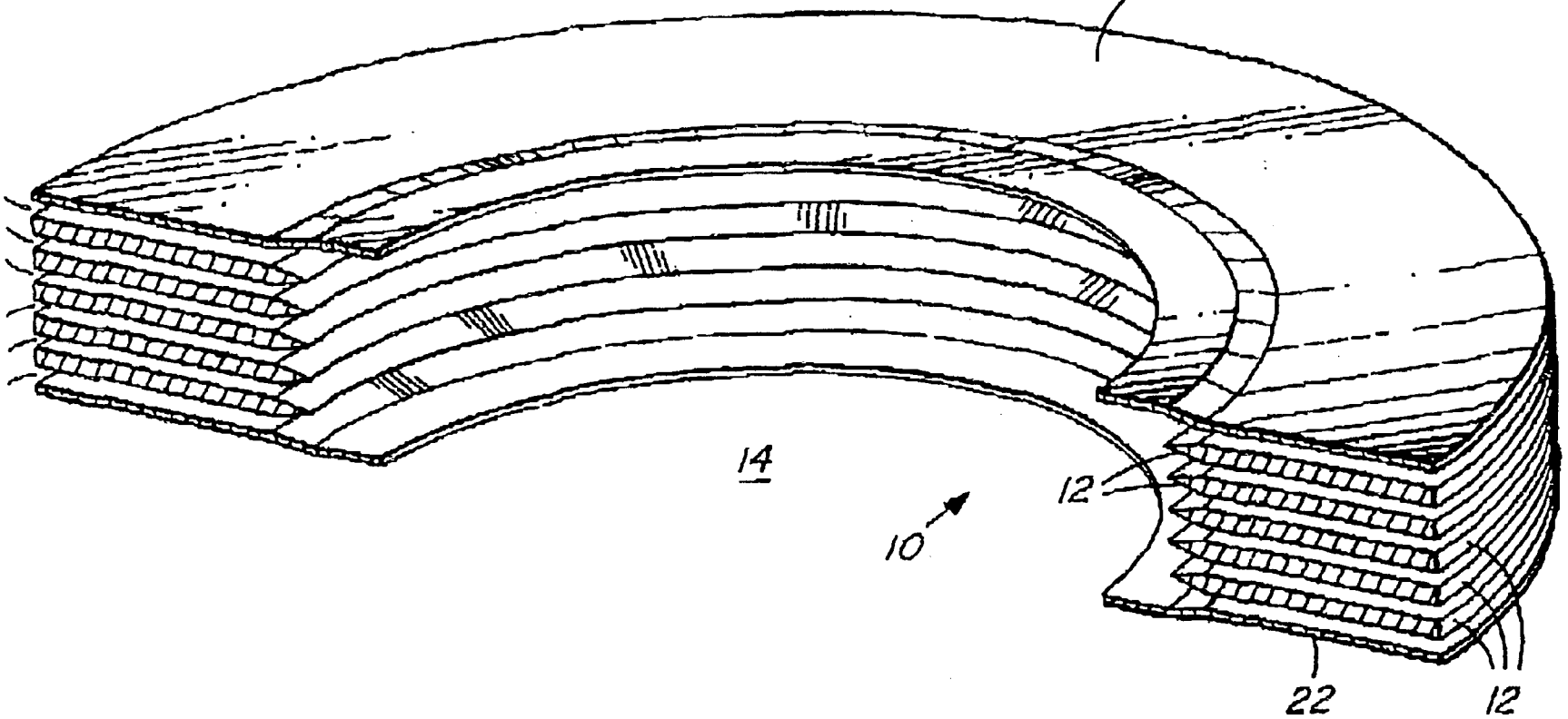
FIG. 2 is a perspective view of one-half of the annulus corresponding to FIG. 1.

Attention is first directed to FIGS. 1 and 2 for a description of the first embodiment of this invention. The first embodiment provides a pulsating combustor 10 which includes a plurality of like annular plate elements 12 which are stacked in spaced vertical alignment so as to define a central round space 14 containing the common axis 16 of the elements 12, and a plurality of slot-like passages 18, one said passage 18 between each adjacent pair of elements 12.

In the first embodiment, the elements 12 are of uniform thickness for the most part, but they taper to a point 20 at the inner edge.

Two outer jackets 22 enclose the stack of annular plate elements 12 above and below, and cooperate with a head 24 to define a common combustion chamber 21 for all of the slot-like passages 18. The head has one or more intakes 26 for a fuel-air mixture.

With the provision of the head 24, the passages 18 become the equivalent of a plurality of tailpipes, which convey combustion gases radially outwardly from the space defined by the jackets 22 and the head 24.

Figure 3:
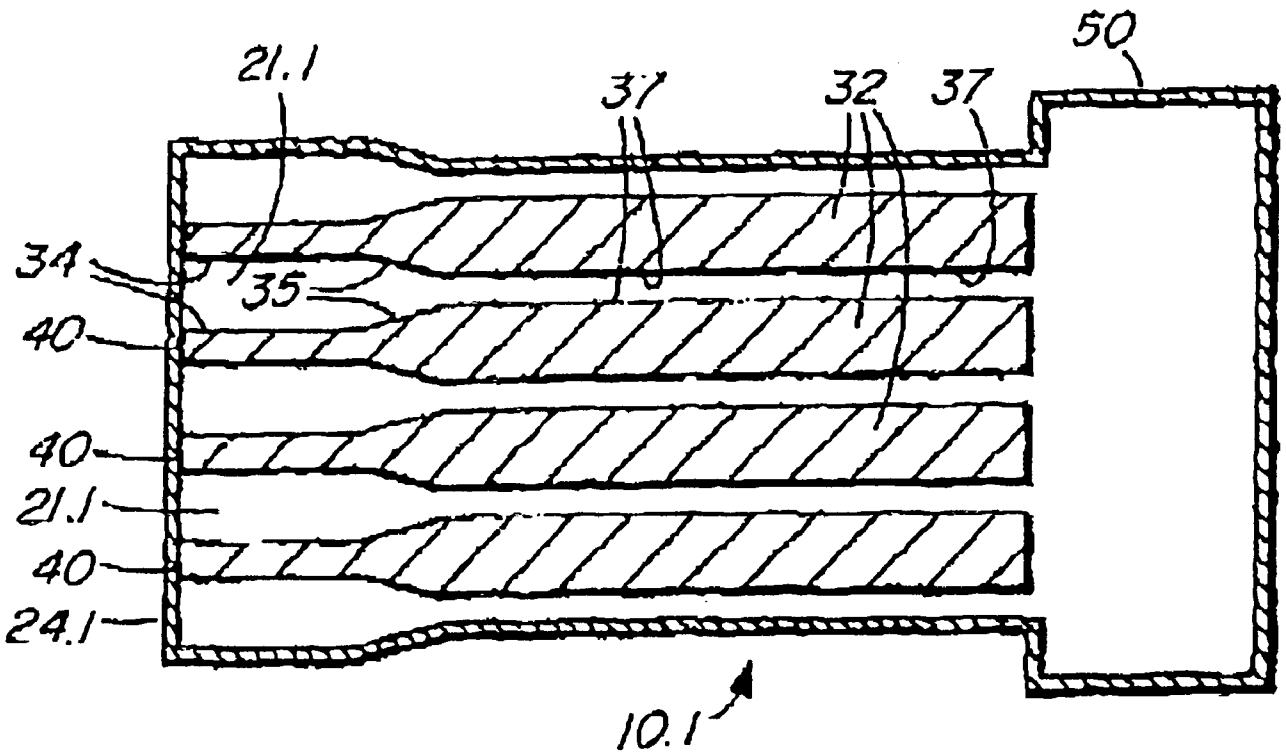
FIG. 3 is a view similar to FIG. 1, showing an embodiment which includes multiple combustion chambers at the inner periphery of the various interelement slots.

Attention is now directed to FIGS. 3 and 4, which illustrate a pulsating combustor 10.1 according to a second embodiment of this invention.

FIG. 3 is similar to FIG. 1 in that it shows a section through a stack of annular elements, the section being taken in a plane which contains the axis of symmetry 30 of all of the elements 32. The latter differ from the elements 12 shown in FIG. 1 in that each adjacent pair of elements 32 has facing annular walls 34, closer to the central space 14, contiguous with converging walls 35, in turn contiguous with parallel walls 37 which are located radially outwards from the walls 34.

Also shown in FIG. 3 is a vertically arranged, cylindrical head 24.1 which presses firmly against the inner walls 40 of the element 32, thus defining a plurality of annular combustion chambers 21.1, one for each adjacent pair of elements 32. Of course, means would be provided to feed a combustible mixture into the individual combustion chambers, and ignition means would also be provided.

Also seen in FIG. 3 is an external housing 50 which would receive the combustion gases moving radially outwardly along the slots between adjacent pairs of elements 32.

As a further embodiment of this invention, pulsating combustor 10.2, seen in FIGS. 5 and 6, minor modification make it possible to feed the gaseous material radially inwardly rather than radially outwardly. This will require, for the fuel/air mixture, a plurality of intake slots 44 between adjacent, stacked pairs of elements 12.2, and an appropriate housing or plenum. The slots extend radially inwards from radially outer edges 80 of the elements. It will also require removal of exhaust gases from the central space 46 of the annulus or "doughnut", utilizing a suitable housing. It is not necessary to show these modifications in detail, as they will be obvious to the skilled workman in this art.

What is claimed is:

1. A pulsating combustor (10.2) of the type including a pair of annular plate elements (12.2) stacked so as to define a central space (46) and a passage (18) between the pair of elements, at least one combustion chamber (21) in communication with said passage, first means for feeding fuel and combustion air to said at least one combustion chamber and second means for igniting a fuel-air mixture in said at least one combustion chamber, the combustor being characterized by:

the plate elements having radially outer edges (80) and an intake slot (44) between the pair of elements (12.2) and extending inwardly from the outer edges (80), whereby gaseous material is fed radially inwards from the outer edges of elements to the central space (46).

2. A pulsating combustor as in claim 1, wherein there are at least three annular plate elements (12.2), a plurality of said passageways (18), one such passageway between each adjacent pair of said elements, and a plurality of intake slots (44) between said each adjacent pair of elements.

3. A combustor as claimed in claim 1, wherein each of the plate elements (12.2) tapers to a point (20) adjacent the central space.

4. A combustor as claimed in claim 1, wherein each of the plate elements (12.2) has annular walls (34) on each side thereof, said walls being closer together adjacent to the central space than said walls located radially outwards therefrom.

5. A combustor as claimed in claim 4, wherein said each of the plate elements (12.2) has converging walls (35) extending between said walls closer to the central space and said walls located radially outwards therefrom.

6. A combustor as claimed in claim 1, wherein the plate elements are stacked in spaced vertical alignment.

7. A combustor as claimed in claim 6, wherein the central space contains a common axis of the elements.

8. A combustor as claimed in claim 1, wherein the central space is a round opening.

* * * * *